United States Patent [19]

Reiter

[11] Patent Number: 4,541,458

[45] Date of Patent: Sep. 17, 1985

[54] ELECTROMECHANICAL CONTROL MEANS FOR CONTROLLING MOVEMENT SEQUENCES IN A TEXTILE MACHINE

[75] Inventor: Josef Reiter, Bleialf, Fed. Rep. of Germany

[73] Assignees: Reiter GmbH, Bleialf, Fed. Rep. of Germany; OMM Officine Meccanotessili Monza S.p.A., Monza, Italy

[21] Appl. No.: 476,231

[22] Filed: Mar. 17, 1983

[30] Foreign Application Priority Data

Mar. 18, 1982 [DE] Fed. Rep. of Germany ..... 3209958

[51] Int. Cl.[4] ..... D03C 13/00

[52] U.S. Cl. ..... 139/55.1; 139/455

[58] Field of Search ..... 139/55.1, 455, 319, 139/145, 1 E, 66 R, 76; 66/205

[56] References Cited

U.S. PATENT DOCUMENTS

| | | | |
|---|---|---|---|
| 2,136,090 | 11/1938 | Tandler et al. | 139/455 |
| 4,285,217 | 8/1981 | Mista et al. | 139/455 X |
| 4,298,031 | 11/1981 | Genini | 139/55.1 |
| 4,458,725 | 7/1984 | Schwarz | 139/1 E |

FOREIGN PATENT DOCUMENTS

| | | | |
|---|---|---|---|
| 2248341 | 4/1974 | Fed. Rep. of Germany | 139/455 |
| 742861 | 1/1933 | France | 139/1 E |
| 993109 | 6/1965 | United Kingdom | 139/145 |
| 602626 | 4/1978 | U.S.S.R. | 139/55.1 |

*Primary Examiner*—James Kee Chi

*Attorney, Agent, or Firm*—Becker & Becker, Inc.

[57] ABSTRACT

Electromechanical control arrangement for controlling movement sequences in a textile machine, in particular for controlling the warp thread movement in a mechanical loom. The control arrangement includes a control cam, over the face of which a push member runs which effects the movement which is to be controlled; a continuously running drive shaft for the control cam; and a switching or control coupling, which is constructed as a spring coupling, connects the drive shaft and the control cam; and is switched via a magnet in conformity with the control pulses applied thereto, thereby controlling the rotation of the control cam.

5 Claims, 7 Drawing Figures

FIG-1
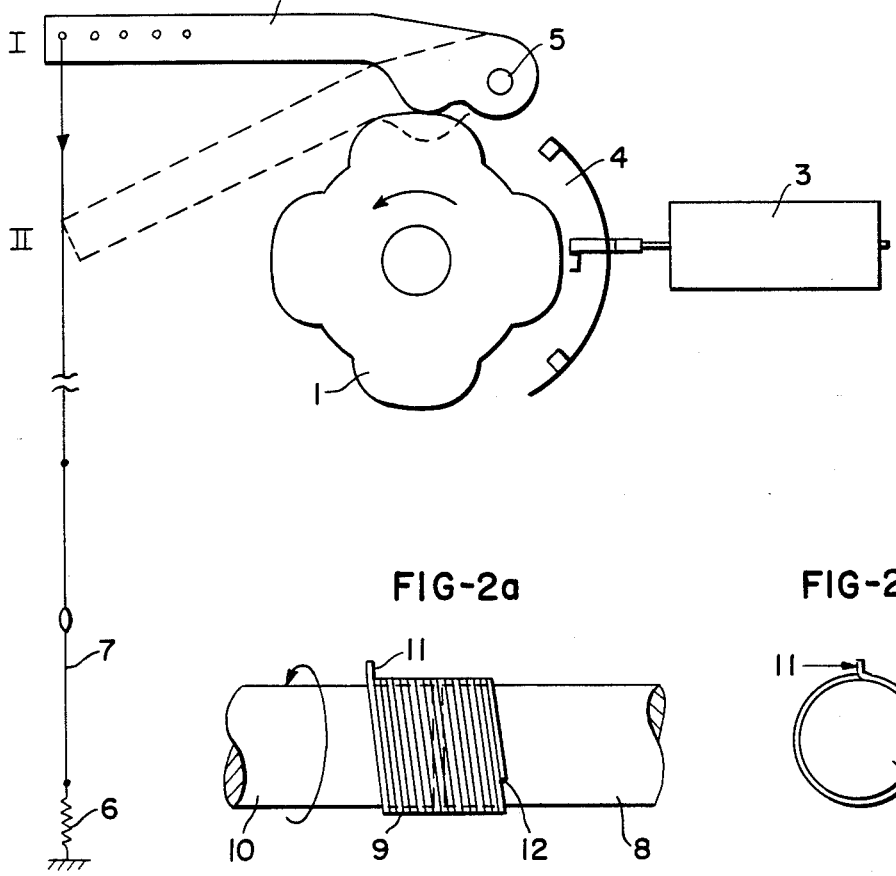
FIG-2a
FIG-2b
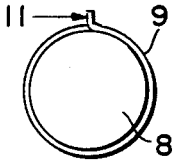
FIG-3
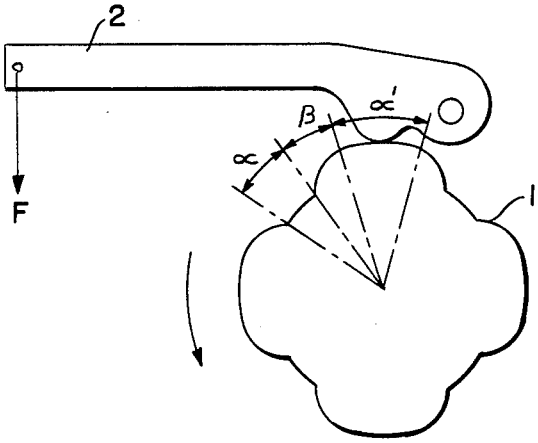

ELECTROMECHANICAL CONTROL MEANS FOR CONTROLLING MOVEMENT SEQUENCES IN A TEXTILE MACHINE

BACKGROUND OF THE INVENTION

The present invention relates to an electromechanical control means for controlling movement cycles or sequences in a textile machine, in particular for controlling the warp thread movement in a mechanical loom.

Up to now, the control, for example of warp and weft patterned ribbons in a mechanical loom, was effected mechanically in that a card perforated in conformity with the desired pattern is scanned via a sensing means. The loom is controlled via the sensing means in such a manner that the corresponding pattern is woven.

The construction of such a program and sequence control electronically leads to a considerable saving in work and permits substantially higher weaving speeds, provided that appropriate mechanical devices are present which can convert the electronic pulses or forces into a mechanical movement, and which operate reliably. With suitable mechanical means and adapted electronic control, up to 100 percent higher working speeds, and thus up to 100 percent higher weaving speeds of a loom, are possible, apart from the saving in work in programing the weaving pattern.

It is an object of the present invention to provide an electromechanical control means for controlling movement sequences in a textile machine, and in particular for controlling the warp thread movement in a mechanical loom, which can operate in conjunction with an electronically designed control and which reliably can convert the electronic control pulses to the necessary mechanical movement sequences.

BRIEF DESCRIPTION OF THE DRAWINGS

This object, and other objects and advantages of the present invention, will appear more clearly from the following specification in conjunction with the accompanying drawings, in which:

FIG. 1 is a front elevation of one embodiment of the control means according to the present invention;

FIGS. 2*a* and 2*b* are side and front elevational views of the coupling spring to illustrate the operating principle of the spring coupling provided in the inventive control means;

FIG. 3 shows the control cam with associated push member in front elevation;

SUMMARY OF THE INVENTION

Figure 4:
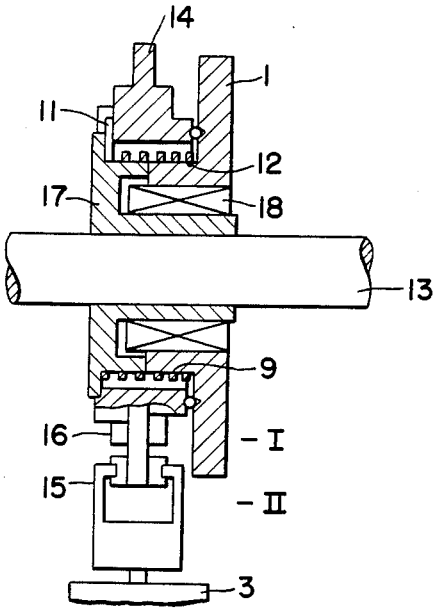
FIG. 4 is a partially sectioned side elevation of the exemplary embodiment of the control means according to the invention.
Figure 5A:
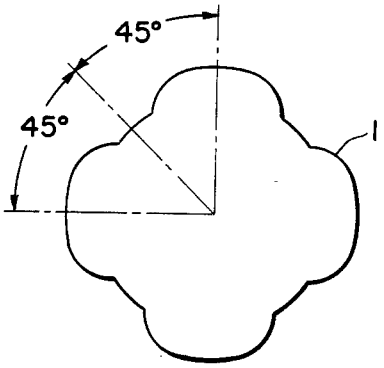
FIGS. 5*a* and 5*b* show front elevational views of the control cam and the drive disk to illustrate the control functions in one exemplary embodiment of the present invention.
Figure 5B:
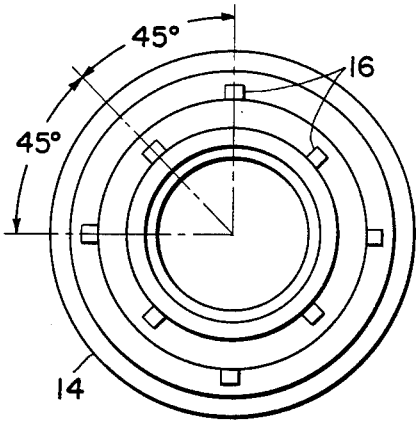

The control means of the present invention is characterized primarily by a control cam, over the control face of which a push member runs to effect the movement sequence that is to be controlled; a drive shaft for the control cam; a spring coupling which connects the drive shaft to the control cam; and an electromagnet, which is energized by electrical control signals and in conformity therewith engages and disengages the spring coupling.

Pursuant to preferred further developments of the control means of the present invention, the spring coupling may include a torsion spring, wich is disposed concentrically about a sleeve of the control cam and about the drive shaft, and has an internal diameter which is smaller than the external diameter of the sleeve of the control cam and of the drive shaft; one end of the spring is connected fixedly to the control cam or to the drive shaft, and the other end of the torsion spring is engaged and released by magnets for engaging and disengaging the coupling.

A hub disk may be fixed on the drive shaft, and the torsion spring of the spring coupling may be mounted thereon.

A drive disk may be mounted on the drive shaft so as to be movable relative thereto, and may be in engagement with the other end of the torsion spring; circumferentially spaced, axially projecting stops may be provided on at least one side face of the drive disk. A gripping member of the electromagnet can come into engagement against these stops. The gripping member is movable into the path of movement of the stops and out of the path of movement of the stops by the electromagnet.

On the drive disk, in radially spaced relationship, two rows of circumferentially spaced stops may be provided, with the gripping member of the electromagnet, in the energized or de-energized state of the electromagnet, being disposed respectively in the path of movement of one row of stops.

Stops may be provided on both sides of the drive disk directly opposite each other. The gripping member of the electromagnet may be U-shaped, with its legs engaging the stops on both sides of the drive disk.

If the control means of the present invention is used for controlling the warp thread movement in a loom, the design, for example, may be such that when the magnet is energized, the warp thread raised synchronously with the movement of the loom as long as the magnet is energized. On the other hand when the magnet is de-energized, the warp thread is lowered synchronously with the movement of the loom as long as the magnet is de-energized. The shed thus formed has an exactly observed opening angle of, 11 degrees for example.

The control means of the present invention permits working speeds of about 2000 double weft entries per minute, guarantees a high operational reliability, and can be constructed in modular manner, i.e. is extendable as desired.

Moreover, such a control means requires almost no maintenance, and since the forces and torques which are to be transmitted are small, the individual parts can be made from plastic, so that only small masses result.

The control means of the present invention is not restricted to the control of warp thread movement in a mechanical loom; on the contrary, the inventive control means can be used inter alia for controlling individual warp threads, for shaft control, for weft thread feed, for color change in multi-bobbin automatic needle machines, and in crochet machines.

High speeds can be obtained because, for switching the coupling provided in the control means of the present invention, only small forces are required. Accordingly the power of the magnet for example may be 1.5 W and the switching travel small, so that a stroke of the magnet of 2 mm for example is adequate. Tests have given speeds up to 2500 switching operations per minute. The power electronics may be made small, and the energy requirement is low.

DESCRIPTION OF A PREFERRED EMBODIMENT

Referring now to the drawings in detail, the exemplary embodiment of the inventive control means illustrated in FIG. 1 utilizes a continuous drive motion, i.e. the continuously running drive shaft which is connected via a mechanical coupling to the control cam 1. This keeps mass changes as small as possible. In conformity with the height and depth of its control faces, the control cam 1 raises and lowers a push member 2 which is constructed as a lever arm and which is freely secured at a fulcrum 5. In FIG. 1, thc positions I and II of the push member are illustrated.

The control cam 1 is driven via a drive disk 4 by a magnet 3. A cord 7 is connected to the push member 2 via a harness. An elastic return means 6 pulls the member 2 into the position II. The control cam 1 presses the member 2 into the position I.

The control cam 1 is connected via a spring coupling to a continuously running drive shaft, the operating principle of which is described hereinafter with reference to FIGS. *2a* and *2b*.

Two shafts 8 and 10, which have the same diameter and are disposed along the same axis, are connected to one another by means of a torsion spring 9. The torsion spring 9 is secured to the shaft 8 at a point 12. If the internal diameter of the torsion spring 9 is somewhat smaller than the external diameter of the shafts 8 and 10, and if the torsion spring 9 is coiled to the right, the torsion spring 9 closes when the shaft 10 is turned to the left, so that the torque is transmitted to the shaft 8 and the torque delivered to the shaft 10 can be taken from the shaft 8. To disengage the shaft 8, the other end 11 of the torsion spring 9 is connected to a fixed point. The torsion spring 9 then opens until the position of the shaft 8 has stabilized with respect to the fixed point. A force thereby arises which is equal to the force which must be applied to disengage the shafts 8 and 10. Additional to this force, there are the centrifugal force of the mass of the shaft 8, and possibly frictional forces.

If the force for operating the coupling is kept very small by an appropriate choice of the material of the shaft 10, by the nature of the surface of the shaft 10, and by the material of the spring 9, then via this small force there can be transmitted large torques by the shaft 10 to the shaft 8. This applies, however, only if at the instant of the switching, i.e. the engagement or disengagement of the coupling, there is no torque at the shaft 10 or only a very small torque, possibly because of the rotating shaft 10 due to its mass or friction. This force would add to the operating force of the coupling so as to make engagement or disengagement more difficult.

For controlling movement sequences in textile machines, in particular for controlling the warp thread movement in a loom, in an exemplary embodiment of the invention illustrated in FIGS. 3 and 4, a control cam having the form illustrated in particular in FIG. 4 is mounted on a drive shaft 13 in such a manner that by holding and releasing the torsion spring 9 of the spring coupling, the rotation of the control cam can be controlled. When the control cam rotates in the manner illustrated in FIG. 3, in the angular regions $\alpha$ and $\alpha'$, aside from from the friction, no force is transmitted by the push member 2 to the control cam 1, whereas in the angular region $\beta$, a force F is transmitted via the push member 2 to the cam 1. If therefore the spring coupling with the torsion spring 9 is engaged or disengaged in the regions $\alpha$ and $\alpha'$, then the control cam can be controlled with a small control force and the push member 2 can be brought into the position I or II illustrated in FIG. 1. When the control cam has the quadruple form illustrated in FIG. 3, to keep the speed of rotation of the shaft 13 as small as possible and to reduce wear, for the shaft 13 in a loom having 2000 double weft insertions per minute, the resulting speed of rotation is $2000/8=250$ r.p.m.

FIG. 4 illustrates in detail the construction of the exemplary embodiment of the control means according to the invention.

Connected to the drive shaft 13 is a coupling hub 17. The coupling hub 17 would correspond to the shaft 10 in FIG. *2a*. The control cam 1 is mounted in the manner illustrated in FIG. 4 on the coupling hub 17 by means of a free-wheel needle bearing 18 of low friction and only one direction of rotation. The control cam in FIG. 4 corresponds to the shaft 8 in FIG. *2a*. The torsion spring 9 is connected via the coupling hub 17 to the control cam 1, and is secured to the latter. Placed in a freely supporting manner over the torsion spring 9 there is a drive disk 14 which is connected to the torsion spring 9 at a point 11. For a control cam 1 having quadruple control curves, the drive disk has four stops for the up:vard movement, and four stops 16 for the downward movement, as shown in detail in FIGS. *5a* and *5b*. These stops are arranged off-set by 45 degrees in each case.

The control magnet 3 controls the drive disk 14 via a gripping member 15. When the coupling hub 17 rotates, the gripping member 15 is pressed by the operation of the control magnet 3 into the position I, so that the drive disk 14 is released and the torsion spring 9 closes. The control cam 1 is thereby entrained or taken along via the torsion spring 9 and presses the push member 2 into the position I in FIG. 1. When the push member 2 has arrived on the radial face of the control cam at the angle $\alpha'$ in FIG. 3, the gripping member 15 stops the drive disk 14. The torsion spring 9 opens and the rotation of the control cam 1 is interrupted. If the magnet, which may be constructed for example as a double stroke magnet, is retracted, the drive disk 14 is again freed, so that the coupling hub 17 entrains the control cam 1 via the torsion spring 9 up to the position II in FIG. 1. The push member 2 moves into the position II. In the angular region $\alpha$, the gripping member 15 stops the drive disk 14, so that the torsion spring 9 again opens and the cam 1 remains stationary in the angular region $\alpha$.

The formation of the angular regions of the control cam, and the arrangement of the stops 16 of the drive disk in two radially spaced rows, i.e. annular rows which are radially spaced from one another, with the stops at a predetermined angle to each other in the peripheral direction, are illustrated in detail in FIG. *5b*.

The present invention is, of course, in no way restricted to the specific disclosure of the specification and drawings, but also encompasses any modifications within the scope of the appended claims.

What I claim is:

1. Electromechanical control means for controlling movement sequences in a textile machine, said control means comprising:

a control cam having a control face;

a push member which runs over said control face of said control cam, said push member effecting the movement sequence in the textile machine which is to be controlled;

a drive shaft;

a spring coupling for connecting said drive shaft to said control cam; and and electromagnet which is adapted to be energized by electrical control signals respectively for engaging and disengaging said spring coupling to be operative in conformity therewith, said control cam including a sleeve, and said spring coupling including a torsion spring which is disposed concentrically respectively in spring clutch relationship about said sleeve of said control cam and about said drive shaft; said torsion spring having two ends, one which is fixed to one of said control cam and said drive shaft, with the inner diameter of said torsion spring being smaller than the outer diameter of said one of said control cam and said drive shaft to which said one end is fixed; the other end of said torsion spring being adapted to be engaged and released by said electromagnet respectively for effecting said engagement and disengagement of said spring coupling.

2. Control means according to claim 1, which includes a hub disk which is fixed on said drive shaft, said torsion spring of said spring coupling being mounted on said hub disk.

3. Control means according to claim 1, which includes a drive disk which is mounted on said drive shaft in such a way as to be movable relative thereto, said drive disk being in engagement with said other end of said torsion spring; at least one face of said drive disk being provided with axially projecting stops which are spaced from one another in the circumferential direction; and in which said electromagnet is provided with a gripping member which is adapted to engage said stops, said gripping member being movable by said electromagnet into and out of the path of movement of said stops.

4. Control means according to claim 3, in which said drive disk is provided with two rows of circumferentially spaced-apart stops, said rows of stops being radially spaced from one another; said gripping member of said electromagnet, both in the energized and de-energized state of said electromagnet, respectively being disposed in the path of movement of one of said two rows of stops.

5. Control means according to claim 3, in which both sides of said drive disk are provided with stops which are disposed directly opposite each other; and in which said gripping member of said electromagnet is U-shaped, with the legs thereof engaging said stops on both sides of said drive disk.

* * * * *